US006074177A

United States Patent [19]

Kobayashi et al.

[11] Patent Number: 6,074,177

[45] Date of Patent: Jun. 13, 2000

[54] AIR COMPRESSOR WITH AIR DRIER HAVING A BYPASS PASSAGE DISPOSED IN THE AIR DRIER

[75] Inventors: Kan Kobayashi, Tokyo; Takashi Onuma, Kanagawa-ken, both of Japan

[73] Assignee: Tokico Ltd., Kanagawa-ken, Japan

[21] Appl. No.: 09/270,655

[22] Filed: Mar. 16, 1999

[30] Foreign Application Priority Data

Mar. 18, 1998 [JP] Japan ..... 10-090746

[51] Int. Cl.[7] ..... F04B 23/04; F16D 31/02

[52] U.S. Cl. ..... 417/313; 417/502; 96/152; 55/DIG. 17; 95/117; 60/453; 60/456

[58] Field of Search ..... 417/313, 502; 96/152; 55/DIG. 17; 95/117; 60/453, 456

[56] References Cited

U.S. PATENT DOCUMENTS

| | | | |
|---|---|---|---|
| 2,594,108 | 4/1952 | Woodbridge | 95/117 |
| 4,504,081 | 3/1985 | Shimizu et al. | 280/714 |
| 4,575,115 | 3/1986 | Tatemoto et al. | 280/707 |
| 4,685,941 | 8/1987 | Sato | 96/114 |
| 5,393,087 | 2/1995 | Taniguchi et al. | 280/6.158 |
| 5,458,677 | 10/1995 | VanderMolen | 96/113 |
| 5,575,833 | 11/1996 | Griffin | 95/117 |
| 5,600,953 | 2/1997 | Oshita et al. | 60/453 |
| 5,711,150 | 1/1998 | Oshita et al. | 60/407 |

*Primary Examiner*—Charles G. Freay
*Assistant Examiner*—Robert Z. Evora
*Attorney, Agent, or Firm*—Wenderoth, Lind & Ponack, L.L.P.

[57] ABSTRACT

The present invention provides an air compressor which includes an air drier filled with a drying agent and having a first passage for supplying compressed air to one air supplied part while absorbing moisture from the compressed air by passing the compressed air through the drying agent (27) and a second passage (28*a*) for supplying the compressed air to another air supplied part without passing the compressed air through the drying agent. The air supplied through the first passage returns through the same passage to dry the drying agent.

13 Claims, 2 Drawing Sheets

AIR COMPRESSOR WITH AIR DRIER HAVING A BYPASS PASSAGE DISPOSED IN THE AIR DRIER

BACKGROUND OF THE INVENTION

The present invention relates to an air compressor to be mounted to a vehicle such as a motor vehicle and the like.

Related Background Art

An example of a conventional air compressor is disclosed in Japanese Utility Model Laid-open No. 62-52290 (1987). This air compressor has a multi-purpose function so as to supply compressed air not only to an air suspension of a motor vehicle but also to external parts such as a tire (for air supplying). The air compressor comprises a cylinder head within which a supply passage for supplying air to the suspension and a supply passage for supplying air to the external parts such as the tire branch from one another. Fittings for connection to pipings are attached to outlets of the supply passages of the cylinder head.

Further, the air compressor for supplying the compressed air to an air pressure circuit of the air suspension is provided with an air drier for removing moisture from the supplied air to prevent malfunction due to trapped of water droplets in the circuit.

When the air compressor is operated for a long time, the cylinder head is heated to a high temperature. Particularly, in the above-mentioned air compressor for the air suspension, since the air compressor itself is disposed within a high temperature engine room, the air compressor is heated to a higher temperature.

In the conventional air compressors in which the cylinder head is provided with the fitting for connection to the piping to supply the air to the external parts such as the tire, in order to prevent deformation and/or damage of the piping and a piping coupling due to high temperature, the fitting must be made of high heat-resistance material which is expensive.

SUMMARY OF THE INVENTION

The present invention aims to eliminate the above-mentioned conventional drawback, and an object of the present invention is to provide an air compressor in which deformation and/or damage of a piping and a piping coupling due to high temperature can be prevented.

To achieve the above object, according to the present invention, there is provided an air compressor comprising an air compressing device driven by a drive source, and an air drier connected to a discharge outlet of the air compressing device and having drying agent therein. The air drier has a first passage for supplying compressed air compressed by the air compressing device to one of air supplied parts while passing the compressed air through the drying agent, and a second passage for supplying the compressed air to the other of the air supplied parts without passing the compressed air through the drying agent.

With the arrangement as mentioned above, since pipings for connection to the air supplied parts are not directly connected to a high temperature cylinder head but are connected to the parts via the air drier, it is not required that the pipings have enhanced heat-resistance.

DETAILED DESCRIPTION OF THE INVENTION

Now, an air compressor according to the present invention will be explained with reference to FIG. 1.

Figure 1:
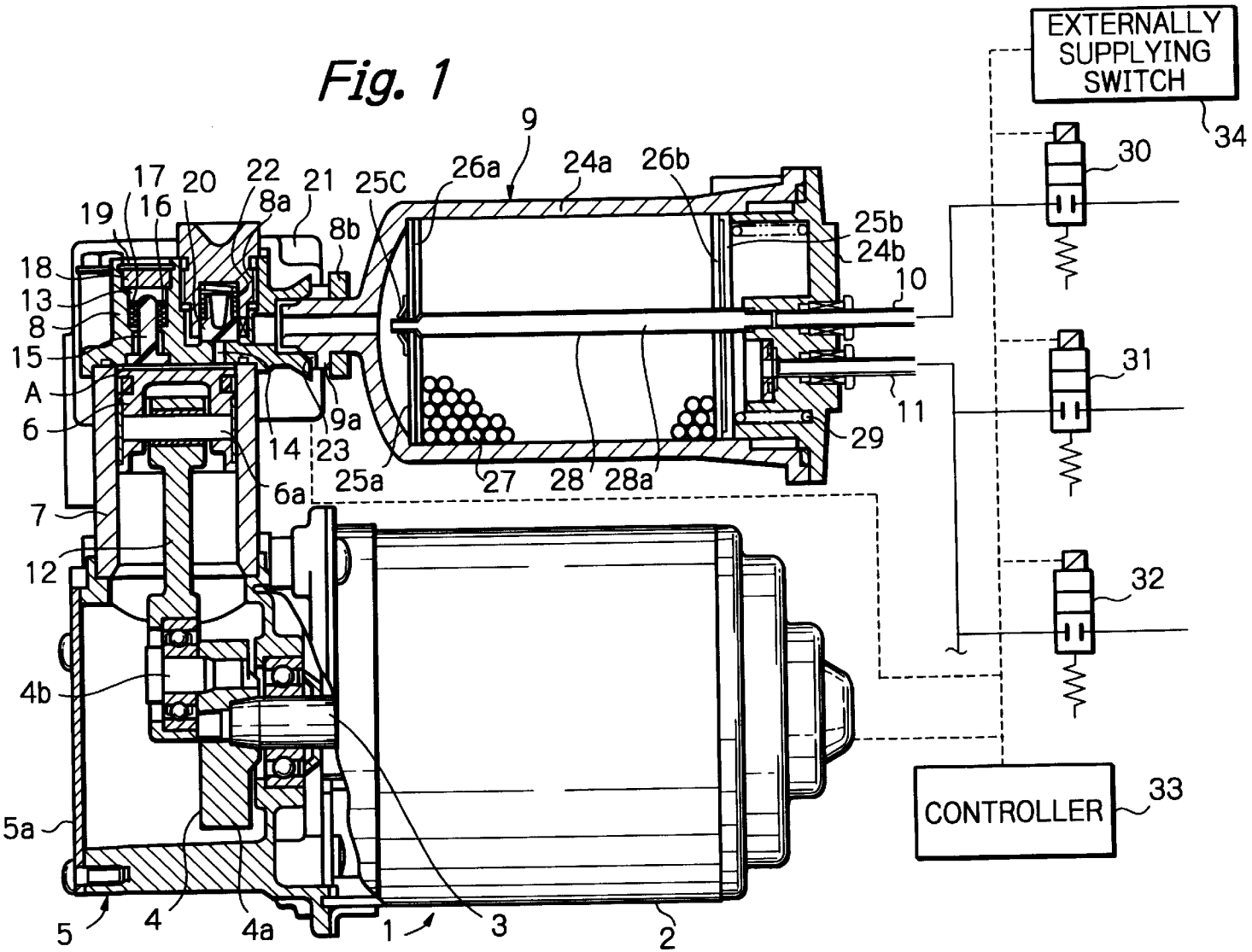
FIG. 1 is a view showing an air compressor according to a preferred embodiment of the present invention.

In FIG. 1, an air compressor generally comprises an electric motor 1 as a drive source, a crank mechanism 4 connected to a rotary shaft 3 protruding from a motor casing 2 of the electric motor 1, a crank casing 5 for containing the crank mechanism 4 therein, a piston (air compressing device) 6 reciprocally driven by the crank mechanism 4, a cylinder 7 for containing the piston 6 and for defining a compression chamber A, a cylinder head (head) 8 connected to the cylinder 7, and an air drier 9 connected to the cylinder head 8 and having a piping 10 for supplying air to an external part (referred to as "externally supplying piping" hereinafter) and a piping 11 for supplying air to a suspension (referred to as "suspension supplying piping" hereinafter).

The motor casing 2 is formed as a cylindrical body having a closed bottom in which one end is closed and the other end is open. The electric motor (drive source) 1 having the rotary shaft 3 is mounted within the motor casing 2. One end of the rotary shaft 3 protrudes from the open end of the motor casing 2.

The crank mechanism 4 includes a balancer portion 4*a* and a crank shaft 4*b*. One end of the rotary shaft 3 is connected to a central portion of the crank mechanism 4 and the entire crank mechanism 4 is contained within the crank casing 5.

One side of the crank casing 5 is connected to the motor casing 2 and the other side of the crank casing is closed by a crank casing lid 5*a*. The crank casing 5 has an open upper end to which the cylinder 7 formed as a cylindrical body is connected. The piston 6 is slidably inserted into the cylinder 7 to define upper and lower chambers in the cylinder. An upper end of a connecting rod 12 is connected to the piston 6 via a piston pin 6*a* and a lower end of the connecting rod 12 is connected to the crank shaft 4*b* of the crank mechanism 4.

The cylinder head 8 is provided with a suction passage 13 for introducing air into the cylinder 7, and a discharge passage 14 for discharging the compressed air after compression. A suction valve 15 is disposed in the suction passage 13. A ring 17 acting as a spring receiving member for receiving a valve spring 16 biasing the suction valve 15 toward a valve closing direction is attached to an upper portion of the suction valve 15. A filter 18 for removing dust when the air is sucked in is press fitted into the suction passage 13 and is secured by a stop ring 19.

A discharge valve 20 formed as a cylindrical body having a bottom is inserted into the discharge passage 14 through an attachment hole 8*a*. The attachment hole 8*a* is provided with an air discharge valve 21 for discharging the air sent from the air drier 9 (the valve 21 is disposed behind the discharge valve 20).

The discharge valve 20 is provided with a valve spring 22 adapted to biasing the valve toward a valve closing direction and surrounding the discharge valve 20. The discharge valve 20 is formed from heat-resistant rubber.

A key-shaped groove 23 is formed in an attachment portion 8*b* of the cylinder head 8, and a projection 9*a* of the air drier 9 is hooked and connected to the groove 23. The air drier 9 comprises an air drier casing 24*a* and a lid 24*b* which are made of heat-resistance resin. The interior of the air drier 9 comprises porous plates 25*a*, 25*b*, and filters 26*a*, 26*b* for preventing powder generated from broken drying agent pieces 27 from flowing through the porous plates are attached to inner surfaces of the porous plates 25*a*, 25*b*. The drying agent pieces 27 of silica gel or the like are loaded or filled between the filters 26*a* and 26*b*. The porous plate 25*b* is biased toward the left by a spring 29 disposed between the porous plate 25*b* and the lid 24*b* so that, when the drying agent pieces are crushed to generate the powder, large spaces are prevented from being created between the drying agent pieces 27.

A tube 28 passing through the porous plate 25*b* extends between the porous plate 25*a* and the lid 24*b*, and the interior of the tube 28 defines a passage (second passage) 28*a* through which the compressed air flows without passing through the drying agent pieces 27. The passage 28*a* is connected with the external supplying piping 10. Incidentally, a left end portion of the tube 28 is prevented from being detaching from the porous plate 25*a* by a stop ring 25*c*. Maintenance (for example, exchange of the drying agent 27) is easily performed, since the tube 28 can be withdrawn from the porous plate 25*a* to remove the porous plate from the drier casing.

A free end of the externally supplying piping 10 is directed to a trunk room and is provided with a coupling (not shown) such as a tire valve core to which a tube to be connected to the air supplied part such as the tire or a floating tube can detachably attached. The external supplying piping 10 is provided at its intermediate part with an external supplying valve 30. The lid 24*b* is further provided with a suspension supplying piping 11 through which the compressed air passed through the drying agent 27 flows toward the suspension and which extends in the same direction as the external supplying piping 10. The passage passing through the drying agents 27 constitutes a first passage. The suspension supplying piping 11 is connected to air chambers (not shown) associated with respective wheels via supply/discharge valves 31, 32, etc. associated with the respective wheels.

A controller 33 is connected to various sensors (not shown) such as a vehicle height sensor, the electric motor 1, the external supplying valve 30, the supply/discharge valves 31, 32, etc., and an external supplying switch 34 which is manipulated by an operator when the air supplied part is connected to the external supplying piping 10 and the compressed air is to be supplied.

Figure 2:
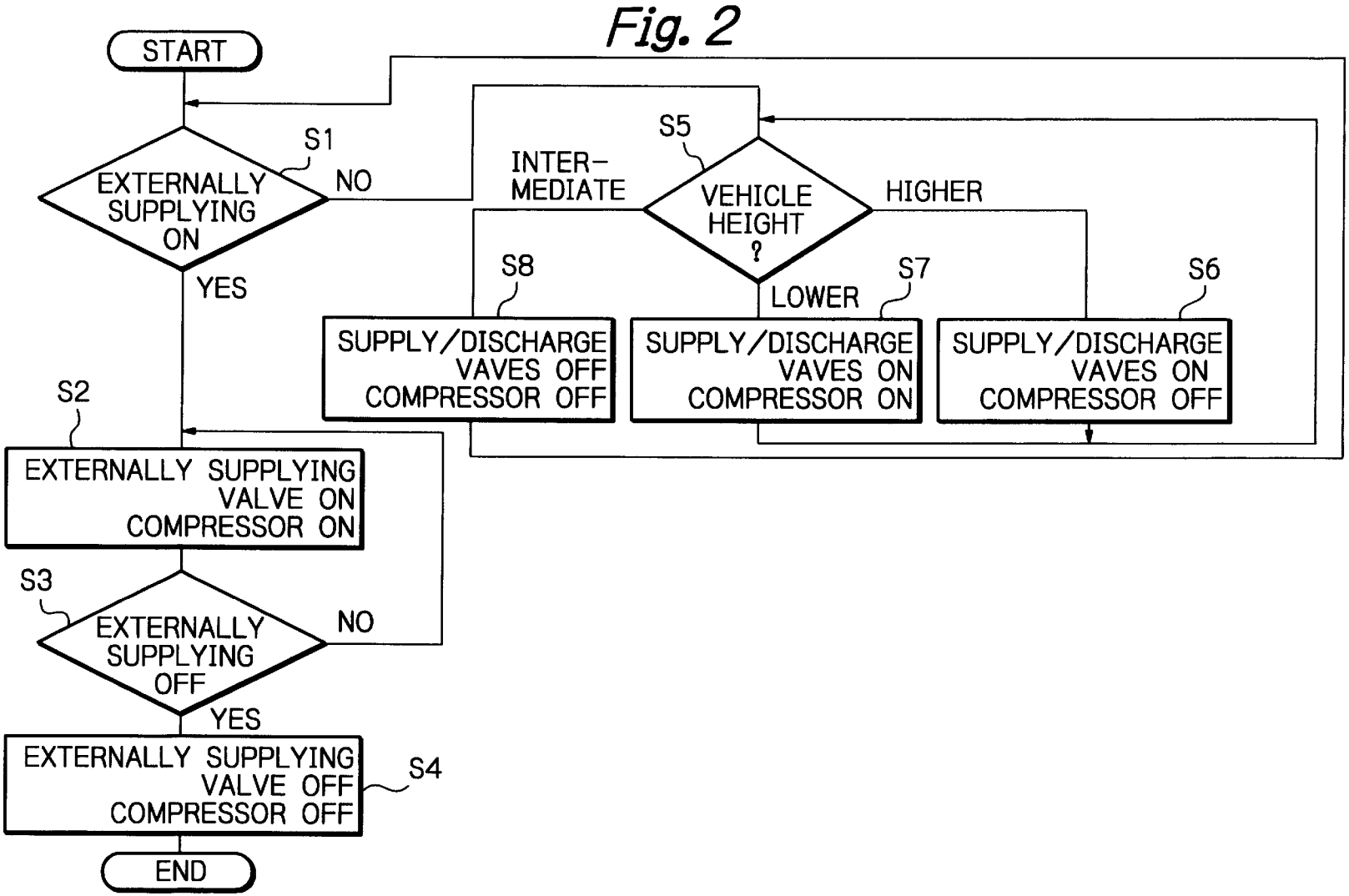
FIG. 2 is a flow chart for explaining control of the air compressor according to the preferred embodiment of the present invention.

Next, an operation of the air compressor will be explained with reference to a flow chart shown in FIG. 2.

First, in a step S1, it is judged whether the external supplying switch 34 is turned ON or OFF. If ON, the program goes to a step S2, whereas, if OFF, the program goes to a step S5.

In the step S2, the compressor (electric motor 1) is energized and the external supplying valve 30 is opened. In a step S3, the program waits until the external supplying switch 34 is turned OFF. When the external supplying switch 34 is turned OFF, the program goes to a step S4, where the compressor is stopped and the external supplying valve 30 is closed.

On the other hand, in the step S5, it is judged whether the vehicle height is within a reference intermediate vehicle height range or higher than such a range or lower than such a range on the basis of a signal from the vehicle height sensor.

If higher, the program goes to a step S6, where the supply/discharge valves 31, 32, etc. and the air discharge valve 21 are opened and the compressor is not energized, thereby discharging the air. In this case, the compressed air in the air chambers flows in a direction opposite to the air supplying direction to dry and recover the drying effect of the agent 27 and then the air is discharged externally through the air discharge valve 21.

In the step S5, if lower, the program goes to a step S7, where the supply/discharge valves 31, 32, etc. are opened and the compressor is energized, thereby supplying the air. If the vehicle height is within the reference intermediate vehicle height range or enters into the reference intermediate vehicle height range, the program goes to a step S8, where the supply/discharge valves 31, 32, etc. are closed and the compressor is stopped, thereby interrupting the vehicle height adjusting operation.

In the embodiment as mentioned above, when the compressed air is to be supplied to the suspension, the compressed air is supplied after it is dried by the drying agent 27. Further, when the compressed air is discharged, the drying agent 27 is recovered from the compressed air. When the compressed air is supplied to the external air supplied parts for various purposes from which the air does not return, the compressed air is supplied without passing through the drying agent 27.

As a result, since the air dried by the drying agent 27 recovers the drying agent 27 without fail, the drying agent does not generally reach a saturated condition, thereby improving service life of the drying agent.

Further, since the external supplying piping 10 and the coupling are disposed near the lid 24*b* of the air drier 9 which is remote from the cylinder head 8 which is heated to a high temperature, deformation and/or damage of the piping and coupling can be prevented.

Since the external supplying piping 10 and the suspension supplying piping 11 extend in the same direction, and the pipings can be housed in the engine room collectively, when the air compressor is installed in the engine room at the rear side thereof, the ease of installation of the air compressor is improved greatly.

In the illustrated embodiment, while it is judged whether the compressed air is to be supplied to the suspension or to the external air supplied part only on the basis of the externally supplying switch 34. In addition, there may be provided a vehicle stop detector such as a safety device for permitting the air supply operation only when a sensor detects actuation of a parking brake, so as not to supply the compressed air during the running of the vehicle. Further, In vehicles in which the vehicle height can be adjusted during the stopping of the vehicle, a vehicle height adjustment preference device for effecting the vehicle height adjustment preferentially may be provided.

In the illustrated embodiment, while an example in which air compressor is used for effecting the vehicle height adjustment of the air suspension mounted on the vehicle was explained, the present invention is not limited to only such an example.

In the illustrated embodiment, while an example in which the electric motor is used as the drive source was explained, the present invention is not limited to such an example, and so long as a rotational force can be obtained from the rotary shaft 3, the engine may be used as the drive source, for example.

Further, in the illustrated embodiment, while an example in which the piston is used as the air compressing device and the present invention is applied to the compressor of reciprocal movement type was explained, the present invention is not limited to such an example, so long as an air compressor utilizes a discharge valve, the present invention may be applied to an air compressor of diaphragm type, for example.

As mentioned above, according to the present invention, since the pipings through which the compressed air is supplied to the air supplied parts are provided in the air drier, deformation and/or damage of members such as the pipings and couplings due to high temperature can be prevented.

Although all of compressed air flows through the air drier, since there is provided the first passage for supplying the compressed air to one of the air supplied parts while absorbing moisture from the compressed air and the second passage for supplying the compressed air to the other air supplied part without passing the compressed air through the drying agents, when the compressed air is supplied to the air supplied part in which removal of moisture is not required, the compressed air is not passed through the drying agent, which prevents the service life of the drying agents from being shortened.

What is claimed is:

1. An air compressor apparatus comprising:

an air compressing device having a discharge outlet; and an air drier connected to said discharge outlet of said air compressing device and having drying agent, wherein said air drier has a first passage for supplying compressed air compressed by said air compressing device to a first air supplied part while passing the compressed air through the drying agent, and a second passage for supplying the compressed air to a second air supplied part without passing the compressed air through the drying agent.

2. An air compressor apparatus according to claim 1, further comprising an external supplying switch for controlling whether the compressed air is supplied to said first air supplied part or said second air supplied part.

3. An air compressor according to claim 1, wherein said first air supplied part comprises a wheel suspension of a vehicle connected to said first passage.

4. An air compressor apparatus according to claim 1, wherein said first air supplied part comprises a height adjustment device for a vehicle, said height adjustment device operable to use the compressed air to adjust a height of the vehicle.

5. An air compressor apparatus according to claim 1, wherein said first passage is operable to discharge the compressed air from the first air supplied part and to dry said drying agent.

6. An air compressor apparatus according to claim 1, wherein said first and second passages extend in the same direction.

7. An air compressor apparatus as claimed in claim 1, wherein said air compressing device comprises a drive source.

8. An air compressor apparatus as claimed in claim 1, further comprising:

a detector operable to allow said air compressing device to operate only when a parking brake of a vehicle is engaged.

9. An air compressor apparatus for use with an air compressor, the air compressor apparatus comprising:

a body containing a drying agent and being adapted for connection to the air compressor;

a first passage within said body, said first passage being operable to supply compressed air from the air compressor while passing the compressed air through said drying agent;

a second passage within said body, said second passage being operable to supply compressed air from the air compressor while bypassing said drying agent; and an external supply switch being operable to selectively supply the compressed air to only one of said first passage and said second passage.

10. An air compressor apparatus as claimed in claim 9, wherein said first passage is connected to a wheel suspension of a vehicle.

11. An air compressor apparatus as claimed in claim 9, wherein said first passage is connected to a height adjustment device for a vehicle, said height adjustment device being operable to use the compressed air to adjust a height of the vehicle.

12. An air compressor apparatus as claimed in claim 9, wherein said first passage is operable to discharge the compressed air and to dry said drying agent.

13. An air compressor apparatus as claimed in claim 9, wherein said first and second passages extend in the same direction.

* * * * *